United States Patent [19]

Hemingway et al.

[11] 3,998,581

[45] Dec. 21, 1976

[54] GASEOUS FUEL BURNERS

[75] Inventors: Maurice Hemingway, Mirfield; Trevor Ward, Dewsbury, both of England

[73] Assignee: Hotwork International Limited, England

[22] Filed: May 12, 1975

[21] Appl. No.: 576,264

[30] Foreign Application Priority Data

May 14, 1974 United Kingdom ..... 2174/74

[52] U.S. Cl. ..... 431/158; 431/352; 432/222

[51] Int. Cl.[2] ..... F23R 1/10

[58] Field of Search ..... 431/158, 352, 10; 60/39.72, 39.65; 432/222

[56] References Cited

UNITED STATES PATENTS

| | | | |
|---|---|---|---|
| 2,654,219 | 10/1953 | Zaba | 431/352 X |
| 3,048,014 | 8/1962 | Schmidt | 60/39.72 R |
| 3,218,134 | 11/1965 | Walsh | 431/352 X |
| 3,792,581 | 2/1974 | Handa | 60/39.65 X |

*Primary Examiner*—Edward G. Favors
*Attorney, Agent, or Firm*—Wolf, Greenfield & Sacks

[57] ABSTRACT

A high velocity gaseous fuel burner has a casing with an inlet end into which air is blown to an outlet end in the form of a nozzle. Within the casing but circumferentially spaced therefrom is an elongated combustion tube into the rear end of which a main burner unit projects a fuel/air mixture. The outlet end of the tube reaches to or into the nozzle and the air blown through the casing passes over the combustion tube, some air passing into the tube through apertures in its wall. A boost burner unit may be mounted through the walls of the casing and tube to project a fuel/air mixture axially towards the casing nozzle to produce further combustion beyond the tube outlet. Valves are provided for controlling the flow of fuel and air to the two burner units jointly and/or separately.

3 Claims, 1 Drawing Figure

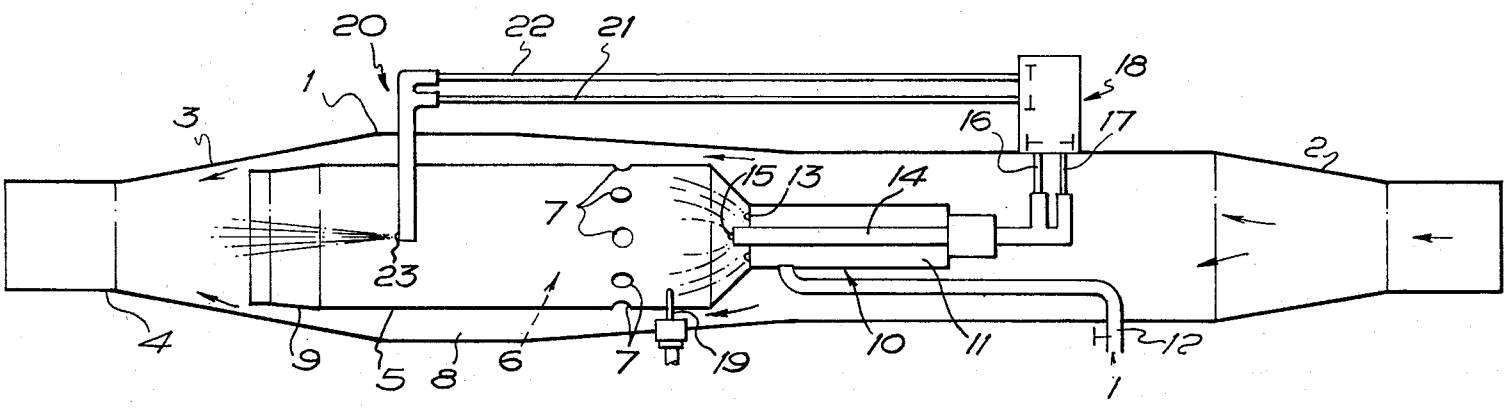
2
3
4
5
6
7
7
8
9
10
11
12
13
14
15
16
17
18
19
20
21
22
23
1
1

GASEOUS FUEL BURNERS

This invention relates to gaseous fuel burners of the kind which provide a high velocity stream of hot gas to be used for various purposes where it is desired to heat up vessels, chambers or the like from the interior by distributing the heat from the hot gas as uniformly as practicable. A burner of this kind and according to the present invention may be used for example for stress-relieving of large pressure vessels, for drying out chambers or furnaces, or for heating up furnaces such as glass melting furnaces.

A burner of the kind referred to has a casing surrounding a combustion zone and this casing tapers towards a nozzle from which the gaseous products of combustion from the burner unit issue, there being means whereby gaseous fuel or liquid fuel and compressed air can be supplied to a burner unit at the rear of the combustion zone and means whereby air can be forced through the casing to mix with the fuel to produce the combustible mixture and also to pass around the combustion zone to the nozzle to increase the velocity of the expelled combustion products.

According to this invention the combustion zone is contained mainly within an elongated combusion tube circumferentially spaced from and within the casing and having its open outlet end tapered and projecting to or into the nozzle, the rear end of this tube receiving said burner unit and the wall of the tube having a multiplicity of apertures spaced all round it to communicate with the annular space between it and the casing. Some of the main air supply flowing past the tube may enter the tube through the apertures, and the flow through the annular space protects the casing from extreme heat.

According to a further feature of the invention an auxiliary burner unit (hereinafter termed boost burner unit) is passed laterally through the casing and combustion tube wall and has its outlet located at the axial centre of the tube but directed axially towards said nozzle so as to produce further combustion beyond the outlet from the combustion tube.

Preferably the boost burner unit is connected or connectible to the same fuel and air supply as is the main burner unit, there being valve control means for varying the mixture at each burner unit independently and also for cutting off supplies to either or both of the burner units.

Preferably also the boost burner unit is so mounted that it can be withdrawn at least from the combustion tube when it is not required for use.

One form of apparatus for carrying out the invention is indicated diagrammatically and by way of example in the accompanying drawing. In this there is shown a tubular casing 1 having an inlet portion 2 and having a tapered outlet portion 3 terminating in a nozzle 4. An elongated combustion tube 5 is circumferentially spaced from and within the casing 1 and defines the amin combustion zone 6, there being a multiplicity of apertures 7 (of which only a few are indicated) giving communication between the zone 6 and the annular space 8 between the tube 5 and the casing 1. The tube 5 tapers towards its outlet end 9 and terminates short of the nozzle 4.

The main burner unit is indicated generally at 10 and includes an inlet chamber 11 which is coupled to a gas supply pipe 12 and has jets or outlets 13. It also includes a central burner pipe assembly 14 through which fuel (for example gas oil) and compressed air can be supplied to jets 15 from supply pipes 16, 17 through suitable valve control means indicated generally by 18. An ignition device 19 in the rear part of the tube 5 serves to ignite the combustible mixture when starting the burner.

Provision is made for blowing air into the inlet end of the casing 1 and through the annular space 8 as indicated by the full-line arrows to the outlet end of the casing where it mingles with the products of combustion emerging from the combustion tube. Not only does this forced flow of air through the space 8 help considerably to protect the casing from extreme heat, but it increases the volume and velocity of the hot gaseous discharge from the burner. Also, some of this air passes through the apertures 7 into the combustion zone 6 to assist in the combustion.

A booster burner unit is indicated generally at 20 and may be similar to the pipe assembly 14. It is passed radially through the casing 1 and the wall of the combustion tube 5 and has its outer end connected by pipes 21, 22 to the fuel and air supply pipes 16, 17 through the control means 18. However, the outlet 23 from this burner is directed axially towards the nozzle 4 so as to project its combustible mixture along the central part of the stream of hot products of combustion leaving the combustion 6. This unit 20 is preferably arranged to be withdrawn at least from the combustion tube when its use is not required, so that it is not unnecessarily exposed to the effects of the main burner unit.

The control means 18 will be arranged to enable the mixture to be varied for each burner unit independently and also for cutting off the supplies to either or both units.

The main gas and oil burner unit 10 at the rear of the combustion chamber preheats the combustion air for the boost burner unit 20, giving a high degree of stability and ensuring a high degree of turn down of this boost, making it possible to operate on the heaviest fuel oils as well as gas and light oil, thereby providing the possibility of operating also on fuel rich or excess fuel conditions such as are necessary or required in some processes.

It also becomes possible by means of this invention to use the boost burner unit as well as the main one instead of running the main burner unit alone at full or maximum output, thereby reducing the damaging heat effect on the outlet nozzle and the adjacent part of the combustion chamber by completing the burning beyond the nozzle or at least beyond the outlet from the combustion tube.

Moreover, the invention enables a choice to be made as to which fuel to use at any particular time in the main burner unit. Gas only may be used or oil only or both together, and if desired the boost burner unit may be fitted up to use gas instead of oil and this oil may be heavy oil.

We claim:

1. In a gaseous high velocity burner of the type having a. an elongate combustion tube, b. a main burner unit at the inlet end of the combustion tube, c. means for supplying fuel and compressed air to the main burner unit, d. a casing surrounding and spaced from the combustion tube, the casing tapering towards a nozzle serving as the outlet for the high velocity burner, the combustion tube having its outler end projecting substantially to the entrance of the nozzle, e. and the combustion tube having multiplicity of apertures remote from its outlet end, the apertures providing communication between the interior of the combustion tube and the space between the combustion tube and the casing, the improvement comprising 1. a boost burner unit disposed in the combustion tube downstream of said apertures, the boost burner unit having its outlet centrally situated in the combustion tube, 2. and means for supplying fuel and compressed air to the boost burner unit whereby a fuel enriched output is emitted from the combustion tube that sustains further combustion beyond the outlet end of the combustion tube.

2. The improvement according to claim 1, wherein the means for supplying fuel and compressed air to the boost burner unit are connected to the same fuel and air supply as the main burner unit and wherein the means for supplying fuel and compressed air to the boost burner unit include valve means for varying the mixture supplied to the boost burner unit independently of the fuel and air mixture supplied to the main burner unit.

3. The improvement according to claim 1, further including 3. mounting means supporting the boost burner unit whereby the boost burner unit can be withdrawn from the combustion tube when use of the boost burner unit is not required.

* * * * *